US008454379B2

(12) United States Patent
Lee et al.

(10) Patent No.: US 8,454,379 B2
(45) Date of Patent: Jun. 4, 2013

(54) CONNECTOR, ELECTRIC CONNECTING DEVICE AND MEDICAL DEVICE

(75) Inventors: Jong Gun Lee, Suwon-si (KR); Tae Soo Kim, Yongin-si (KR); Hong Geun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 216 days.

(21) Appl. No.: 12/832,453

(22) Filed: Jul. 8, 2010

(65) Prior Publication Data

US 2011/0028049 A1 Feb. 3, 2011

(30) Foreign Application Priority Data

Aug. 3, 2009 (KR) ..... 10-2009-0071464

(51) Int. Cl.
*H01R 13/62* (2006.01)

(52) U.S. Cl.
USPC ..... 439/297; 439/113

(58) Field of Classification Search
USPC ..... 439/297, 298, 374, 439, 630, 667, 439/700, 929; 320/113, 115
See application file for complete search history.

(56) References Cited

U.S. PATENT DOCUMENTS

| | | | | | |
|---|---|---|---|---|---|
| 4,481,458 | A * | 11/1984 | Lane | 320/112 |
| 5,315,478 | A * | 5/1994 | Cadwell et al. | 361/679.32 |
| 5,473,242 | A * | 12/1995 | McKenna | 320/113 |
| 5,919,058 | A * | 7/1999 | Tashiro et al. | 439/374 |
| 6,042,414 | A * | 3/2000 | Kunert | 439/374 |
| 6,220,900 | B1 * | 4/2001 | Huang | 439/676 |
| 6,406,333 | B2 * | 6/2002 | Harris | 439/668 |
| 7,431,618 | B2 * | 10/2008 | Jin | 439/630 |
| 7,442,086 | B1 * | 10/2008 | Chang | 439/630 |
| 7,594,823 | B2 * | 9/2009 | Moscovitch | 439/374 |
| 8,109,793 | B2 * | 2/2012 | Faisandier et al. | 439/630 |

* cited by examiner

*Primary Examiner* — Thanh Tam Le
(74) *Attorney, Agent, or Firm* — Sughrue Mion, PLLC

(57) ABSTRACT

Disclosed is a connector to connect an electric element and a power source to each other. The connector includes a first contact provided on a first body and electrically connected to the electric element, and a second contact provided on a second body and electrically connected to the power source, wherein the first contact and the second contact come into contact with or are separated from each other upon receiving pressure caused by relative movement between the first body in the second body.

17 Claims, 8 Drawing Sheets

CONNECTOR, ELECTRIC CONNECTING DEVICE AND MEDICAL DEVICE

CROSS-REFERENCE TO RELATED APPLICATION

This application claims priority from Korean Patent Application No. 10-2009-0071464, filed on Aug. 3, 2009 in the Korean Intellectual Property Office, the disclosure of which is incorporated herein by reference.

BACKGROUND

1. Field

Apparatuses consistent with exemplary embodiments relate to a connector and an electric connecting device to switch an electric element on or off, and a medical device using the same.

2. Description of the Related Art

Various sample-analyzing methods have been developed in diverse application fields, such as environmental monitoring, food testing, and medical diagnosis fields. However, related art testing methods may require numerous manual operations and a variety of equipment. To perform a test based on a predetermined protocol, a skilled experimenter may manually perform, plural times, various operations, such as reagent injection, mixing, separation, movement, reaction, centrifugal separation, etc. This testing method may cause erroneous testing results.

A skilled medical technologist may be necessary to rapidly perform a test. However, even the skilled medical technologist may have significant difficulty performing several tests simultaneously. Since diagnosis of a first-aid patient may need rapid testing results to rapidly adopt temporary measures, there exists a need for a device to rapidly, accurately, and simultaneously perform various pathological tests required per situation.

To fulfill the above-described requirement, automated equipment has been developed, which may rapidly analyze testing materials collected from a single patient or a small number of patients as occasion demands. One example of the automated equipment includes a disc-type microfluidic device, which analyzes a sample, i.e., a body fluid, such as blood, injected into a disc-shaped member by mixing the sample with a reagent using centrifugal force generated upon rotation of the disc-shaped member.

The above-described microfluidic device contains various electrical elements which are mounted therein and connected to one another via cables.

SUMMARY

Exemplary embodiments provide a connector and an electric connecting device to connect or disconnect an electric element via movement thereof, and a medical device using the same. Exemplary embodiments also provide a connector and an electric connecting device to connect or disconnect an electric element by elasticity thereof, and a medical device using the same.

According to an aspect of an exemplary embodiment, there is provided a connector to connect an electric element to a power source, the connector including: a first contact electrically connected to the electric element; and a second contact electrically connected to the power source, wherein the first contact and the second contact come into contact with or are separated from each other upon receiving pressure caused by relative movement between the first contact and the second contact.

The first contact and the second contact may come into contact with or may be separated from each other by elasticity.

The first contact and the second contact may be connected to each other by fitting.

One of the first contact and the second contact may include an elastic member, and another one of the first contact and the second contact may include a rigid member to press the elastic member.

The elastic member may be a leaf spring.

The elastic member may include a coil spring and a pressure plate connected to an end of the coil spring.

According to an aspect of another exemplary embodiment, there is provided an electric connecting device including: a first body including a first contact electrically connected to an electric element; and a second body including a second contact electrically connected to a power source, wherein the first contact and the second contact come into contact with or are separated from each other by elasticity as the first body and the second body are moved relative to each other, so as to switch the electric element on or off.

The first body may be a tray having an interior space to store an article, the tray being movable in a given direction, and the second body may be a stationary frame to support the tray.

The first contact and the second contact may come into contact with each other by elasticity when the tray is inserted into the stationary frame, and may be separated from each other by elasticity when the tray is moved out of the stationary frame.

The electric element may be a heater.

A disc-shaped member receiving a sample therein may be inserted into the interior space of the tray, and the stationary frame may include a drive unit to rotate the disc-shaped member.

The first contact or the second contact may include a leaf spring.

The first contact or the second contact may include a coil spring and a pressure plate connected to one end of the coil spring.

According to an aspect of another exemplary embodiment, there is provided a medical device having an electric element including: a tray including a first contact electrically connected to the electric element; and a frame including a second contact electrically connected to a power source, wherein the first contact and the second contact come into contact with or are separated from each other as the tray and the frame are moved relative to each other, so as to switch the electric element on or off.

According to an aspect of another exemplary embodiment, there is provided an electric connecting device including: a first body comprising a first contact electrically connected to an electric element; and a second body comprising a second contact electrically connected to a power source, wherein the first contact and the second contact come into contact with or are separated from each other by relative movement between the first body in the second, so as to switch the electric element on or off.

BRIEF DESCRIPTION OF THE DRAWINGS

The above and/or other aspects will become apparent and more readily appreciated from the following description of the exemplary embodiments, taken in conjunction with the accompanying drawings of which.

DETAILED DESCRIPTION OF EXEMPLARY EMBODIMENTS

Figure 1:
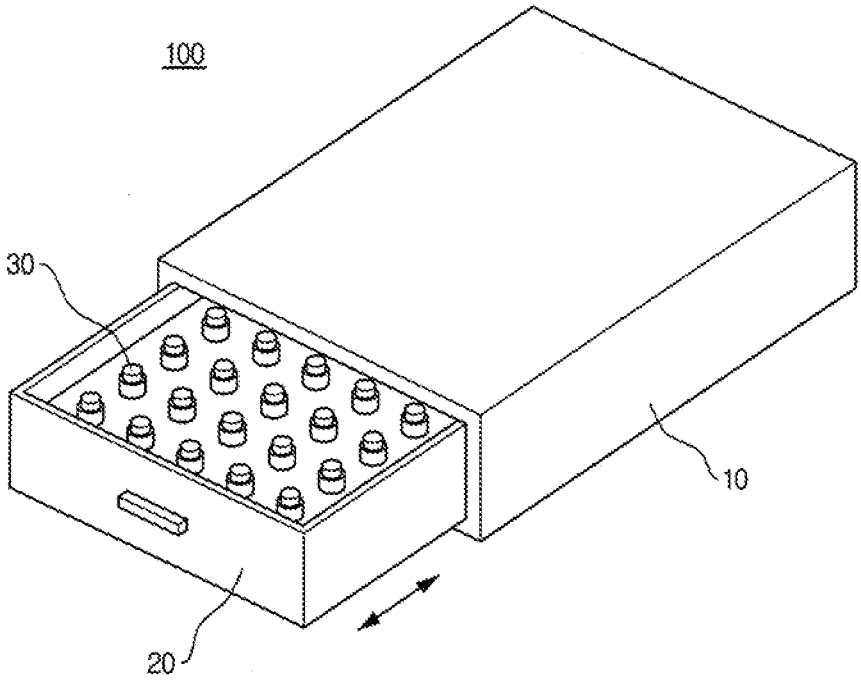
FIG. 1 is a schematic perspective view of a sample storage device according to an exemplary embodiment.

Reference will now be made in detail to the exemplary embodiments, examples of which are illustrated in the accompanying drawings, wherein like reference numerals refer to like elements throughout. Expressions such as "one of" and "at least one of," when preceding a list of elements, modify the entire list of elements and do not modify the individual elements of the list.

Figure 2A:
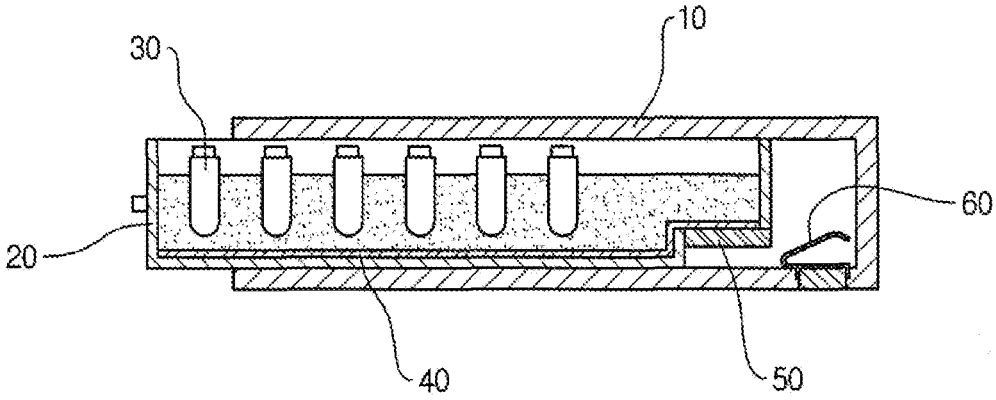
FIGS. 2A and 2B are schematic side sectional views of the sample storage device shown in FIG. 1, respectively illustrating configurations before and after insertion of a tray.
Figure 2B:
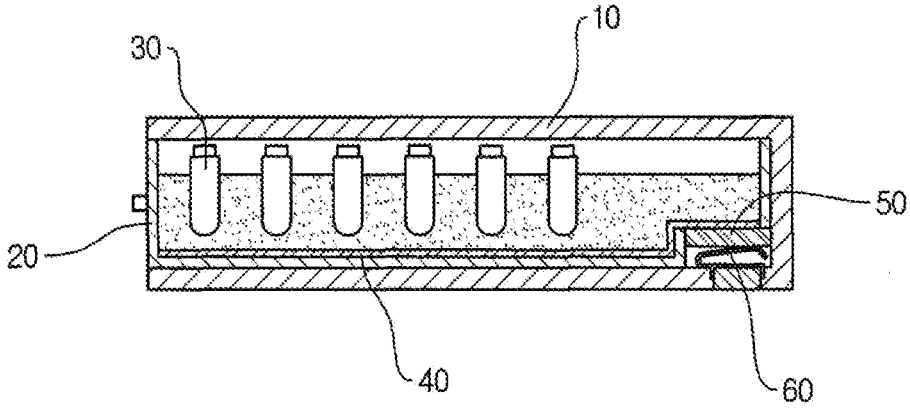

FIG. 1 is a schematic perspective view of a sample storage device 100 according to an exemplary embodiment. FIGS. 2A and 2B are schematic side sectional views of the sample storage device 100 shown in FIG. 1, respectively illustrating configurations before and after insertion of a tray.

Referring to FIG. 1, the sample storage device 100 includes a stationary frame 10 having a single open side, and a tray 20 movably installed in the stationary frame 10. The stationary frame 10 may have a rectangular box shape, although another exemplary embodiment is not limited thereto. The tray 20 may be designed to allow a user to directly open or close the tray 20, or may be automatically opened or closed by a drive unit (not shown).

A plurality of containers 30 to receive a sample, such as blood collected from a person, may be arranged in an interior space of the tray 20.

Referring to FIG. 2A, a heater 40 is mounted in the tray 20 and serves to keep the sample containers 30 at a constant temperature. One end of the heater 40 is electrically connected to a first contact 50. The first contact 50 operates as a connection terminal to supply power to the heater 40. This first contact 50 may be a horizontally extending flat board, and may be made of electric conductors, such as metals including copper, silver, aluminum, etc.

The stationary frame 10 is provided with a main board (not shown). The main board serves as a power source to control supply of power to the heater 40. A second contact 60 protrudes from a sidewall of the stationary frame 10 and is electrically connected to the main board.

The second contact 60 may come into contact with or be separated from the first contact 50 upon receiving pressure by the first contact 50 when the tray 20 is closed. The second contact 60 may be an elastic element to be elastically deformed upon receiving pressure. For example, as shown in FIG. 2A, the second contact 60 may be a leaf spring.

The second contact 60 in the form of a leaf spring comes into contact with the first contact 50 by elasticity. To achieve smooth contact, an upper surface of the leaf spring may be convexly rounded, though another exemplary embodiment is not limited thereto.

As shown in FIG. 2A, no power is supplied to the heater 40 since the first contact 50 is separated from the second contact 60 when the tray 20 is opened. However, as shown in FIG. 2B, when the tray 20 is moved and is inserted into the stationary frame 10, the first contact 50 and the second contact 60 are connected to each other, allowing power to be supplied from the main board to the heater 40.

As the first contact 50 is moved toward the second contact 60 via movement of the tray 20, the second contact 60 is pushed downward by the first contact 50 by elasticity. With an elastic restoration force of the second contact 60, the first contact 50 and the second contact 60 may maintain a robust and flexible connection therebetween. A coupling strength between the first contact 50 and the second contact 60 may be adjusted by an elastic modulus of the second contact 60 in the form of a leaf spring, a height difference between the first contact 50 and the second contact 60, etc.

In the sample storage device 100 according to the present exemplary embodiment, the heater 40 and the main board are selectively connected to each other via relative movement between the first contact 50 and the second contact 60 rather than being connected via a cable. Accordingly, the sample storage device 100 allows the tray 20 to be easily pulled out of the stationary frame 10, enabling easy repair and maintenance and excellent assembly efficiency upon mass production.

The above-described sample storage device 100 may also reduce energy consumption due to unnecessary operation of the heater 40 by switching off the heater 40 when the tray 20 is opened to put the sample containers 30 into the tray 20 or to fill the sample containers 30.

Although FIGS. 2A and 2B illustrate the second contact 60 in the form of a leaf spring, the first contact 50 may be a leaf spring in another exemplary embodiment. For example, the first contact 50 may be a leaf spring electrically connected to the heater 40, and the second contact 60 may be a flat board electrically connected to the main board. The first contact 50 and the second contact 60 of the sample storage device 100 may be changed, in other exemplary embodiments, to other configurations so long as they are moved to come into contact with each other by elasticity.

Figure 3A:
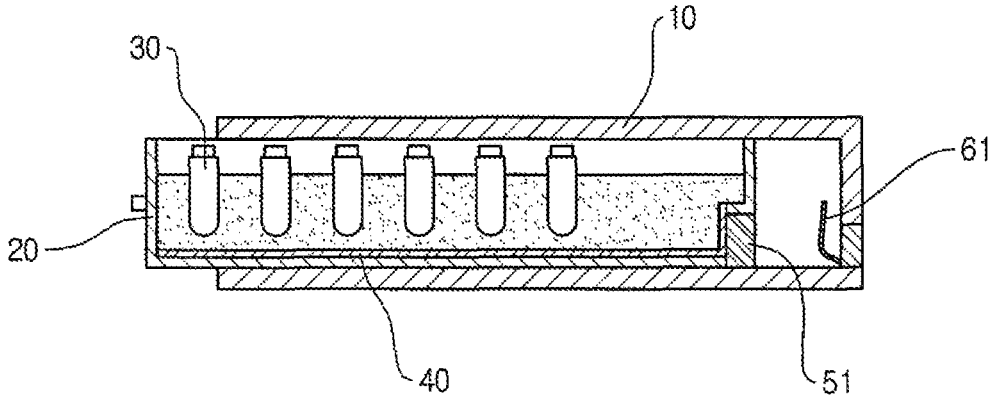
FIGS. 3A and 3B are schematic side sectional views of a sample storage device according to another exemplary embodiment, respectively illustrating configurations before and after insertion of a tray.
Figure 3B:
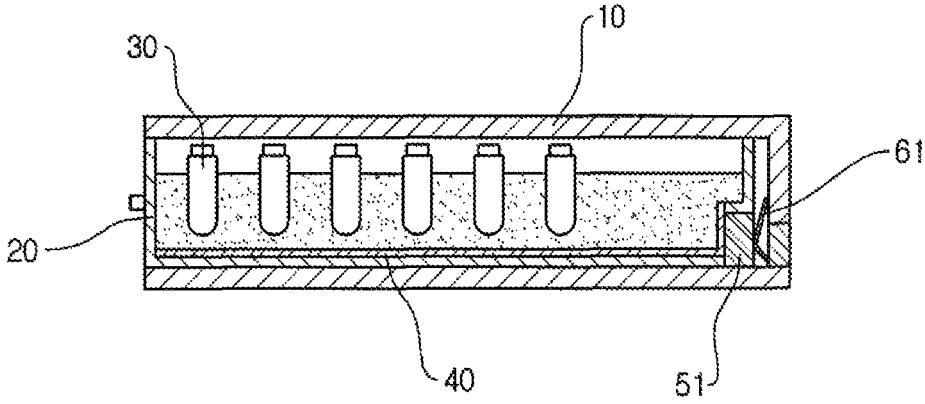
Figure 4A:
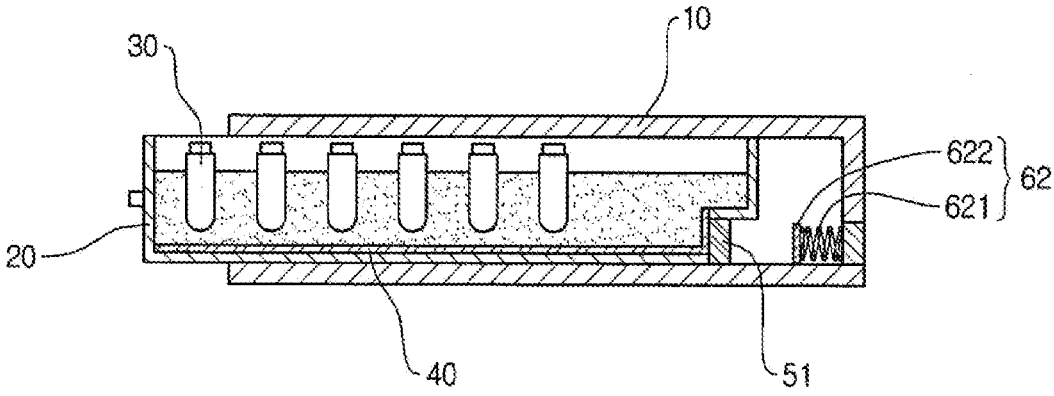
FIGS. 4A and 4B are schematic side sectional views of a sample storage device according to another exemplary embodiment, respectively illustrating configurations before and after insertion of a tray.
Figure 4B:
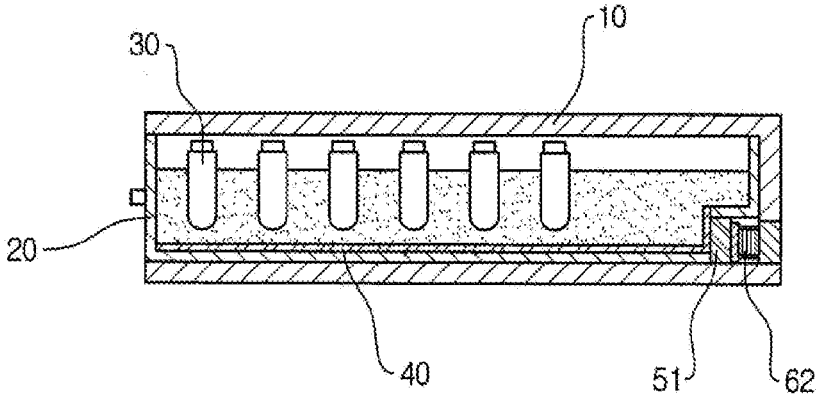
Figure 5A:
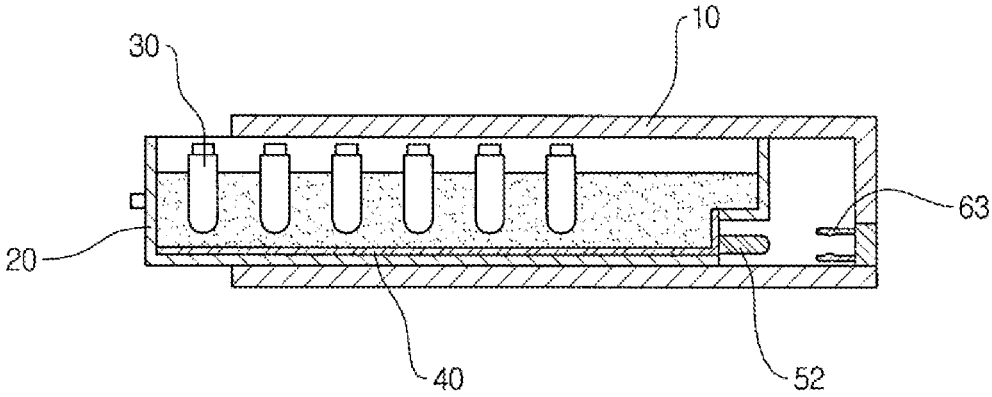
FIGS. 5A and 5B are schematic side sectional views of a sample storage device according to another exemplary embodiment, respectively illustrating configurations before and after insertion of a tray.
Figure 5B:
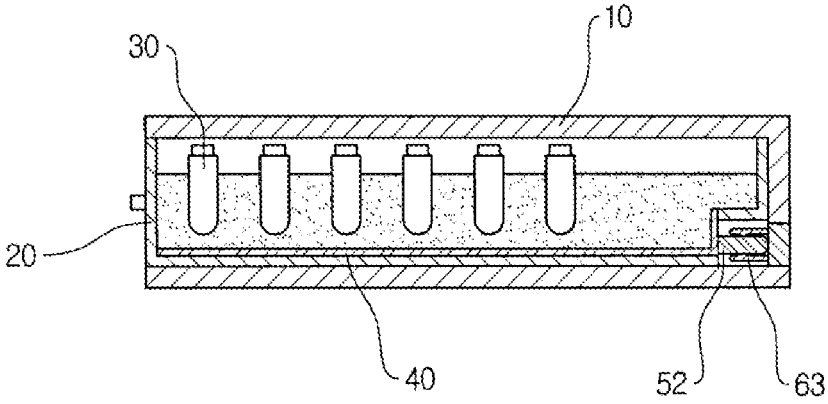

FIGS. 3A and 3B are schematic side sectional views of a sample storage device 100 according to another exemplary embodiment, respectively illustrating configurations before and after insertion of a tray 20. FIGS. 4A and 4B are schematic side sectional views of a sample storage device 100 according to another exemplary embodiment, respectively illustrating configurations before and after insertion of a tray 20. FIGS. 5A and 5B are schematic side sectional views of a sample storage device 100 according to another exemplary embodiment, respectively illustrating configurations before and after insertion of a tray 20.

Referring to FIGS. 3A and 3B, a first contact 51 may be a vertically extending flat board installed at a rear end of the heater 40, and a second contact 61 may be a leaf spring that first protrudes inward from the main board (not shown) and then, extends upward. Accordingly, as the first contact 51 is moved inward, the first contact 51 comes into contact with the second contact 61, causing the second contact 61 to be bent away from the tray 20 by elasticity.

Referring to FIGS. 4A and 4B, a second contact 62 may include a coil spring 621 electrically connected to the main board (not shown), and a pressure plate 622 connected to a distal end of the coil spring 621 to come into contact with the first contact 51 (for example, a vertically extended flat board). As the first contact 51 approaches the second contact 62, the first contact 51 comes into contact with the pressure plate 622, acting to compress the coil spring 621.

Referring to FIGS. 5A and 5B, a first contact 52 and a second contact 63 may be connected to each other by fitting. For example, the first contact 52 may take the form of a rod and the second contact 63 may take the form of a socket having an interior space, so that the first contact 52 is inserted into the second contact 63 so as to be connected to the second contact 63. In this case, the connection of the first contact 52 and the second contact 63 may be accomplished via snap fitting. It is understood that according to another exemplary embodiment, the snap fitting need not be accomplished by the first contact 52 being a rod and the second contact 63 being a socket. For example, according to another exemplary embodiment, the first contact 52 may be the socket and the second contact 63 may be the rod. Furthermore, according to another exemplary embodiment, the snap fitting may be achieved by any two complimentary components other than a rod and a socket.

Although the sample storage device 100 according to the exemplary embodiments described above achieves elastic coupling and separation between the first contact 50, 51, or 52 and the second contact 60, 61, 62, or 63 as the tray 20 is rectilinearly reciprocally moved in the stationary frame 10, the sample storage device according to another exemplary embodiment is not limited thereto. For example, the sample storage device may be configured such that the tray is hinged to a position of the stationary frame to achieve elastic contact between the first contact and the second contact via pivotal rotation thereof. That is, movement paths and directions of the tray may vary according to other exemplary embodiments.

The above-described configuration of the first contact 50, 51, or 52 and the second contact 60, 61, 62, or 63 may be applied to a sample analyzing device as a medical device to analyze a testing material, such as blood collected from a patient.

Figure 6:
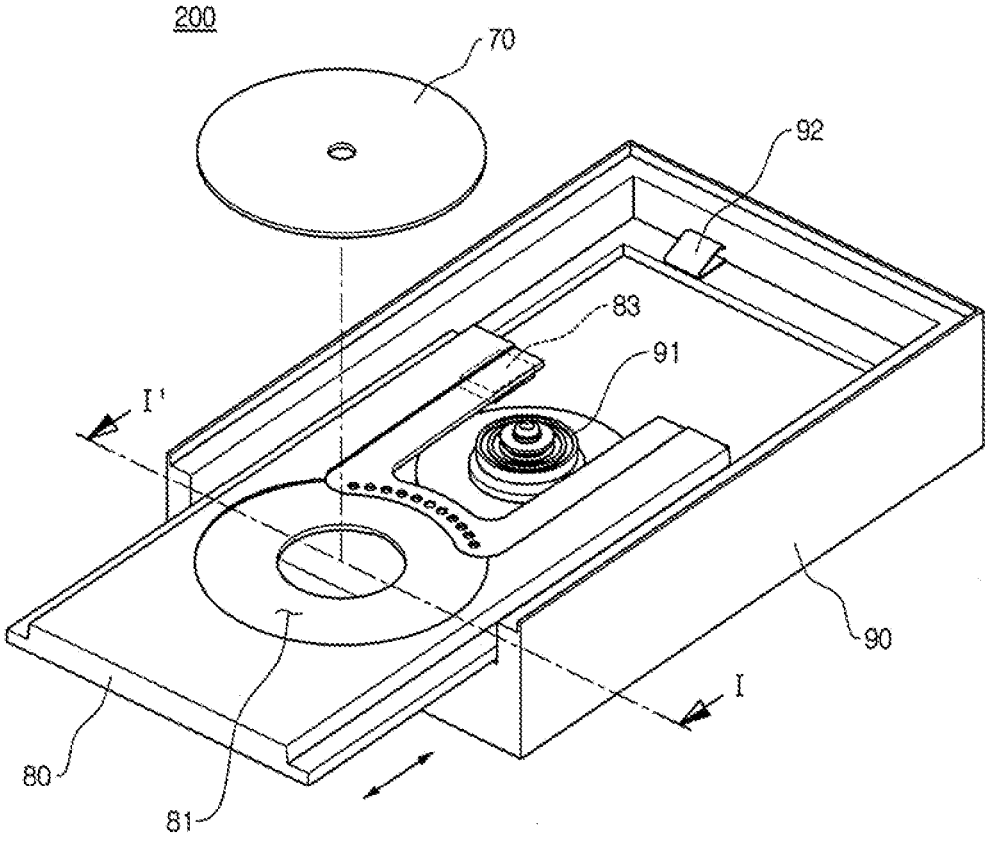
FIG. 6 is a schematic perspective view of a sample analyzing device according to another exemplary embodiment.
Figure 7:
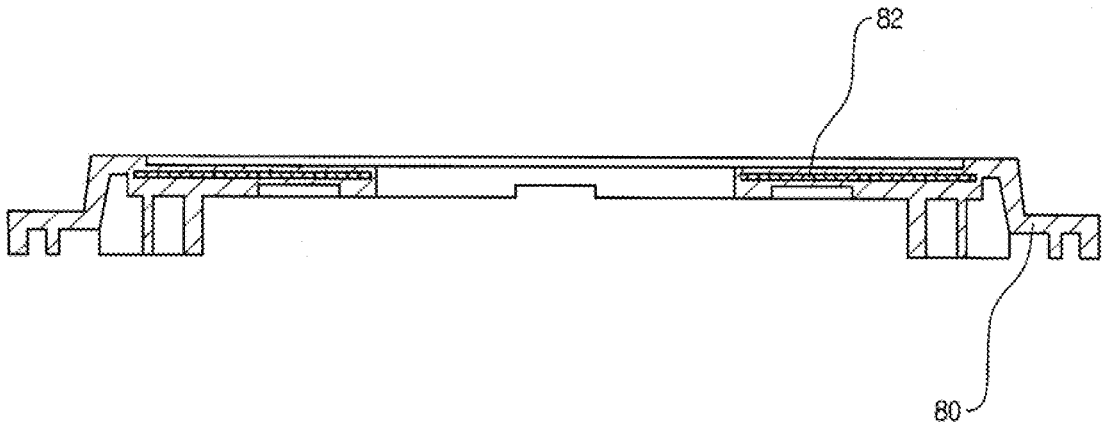
FIG. 7 is a sectional view taken along the line I-I' of FIG. 6.
Figure 8:
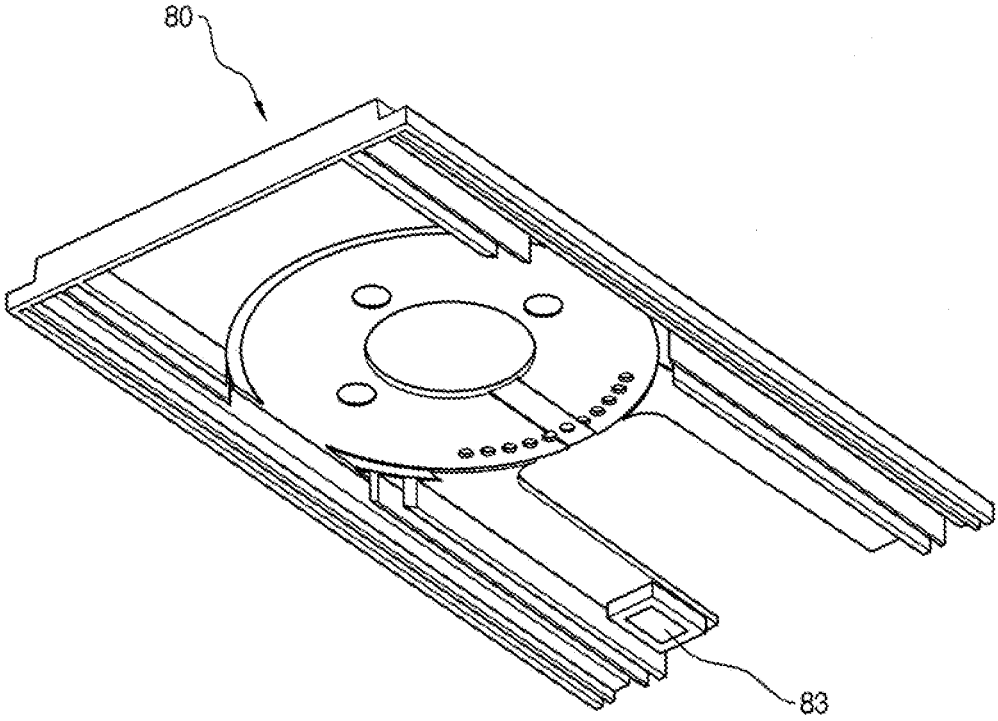
FIG. 8 is a bottom perspective view of a tray shown in FIG. 6.

FIG. 6 is a schematic perspective view of a sample analyzing device 200 according to another exemplary embodiment, FIG. 7 is a sectional view taken along the line I-I' of FIG. 6, and FIG. 8 is a bottom perspective view of a tray shown in FIG. 6.

Referring to FIGS. 6, 7 and 8, the sample analyzing device 200 includes a tray 80 having a space 81 in which a disc-shaped member 70 is placed, and a disc loader 90 having a drive unit 91 to rotate the tray 80 by gripping the tray 80 using a chuck. In the sample analyzing device 200, after a sample, diluent, and reagent are individually injected into the disc-shaped member 70, mixing and separation of the sample are performed by centrifugal force of the disc-shaped member 70.

Specifically, the disc-shaped member 70 at least one sample chamber to receive the sample, a diluent chamber to receive the diluent, and a detecting chamber to receive the reagent. With centrifugal force generated upon rotation of the disc-shaped member 70, the sample is mixed with a predetermined amount of diluent and, thereafter, is moved into the detecting chamber. The sample mixed with the diluent, for example, may change in color due to interaction with the reagent that has been previously injected into the detecting chamber. This color change enables detecting whether the sample contains a specific material.

For example, assuming that the sample is blood, the sample analyzing device 200 may be used to detect serum, aspartate aminotransferase (AST), albumin (ALB), alkaline phosphatase (ALP), alanine aminotransferase (ALT), amylase (AMY), blood urea nitrogen (BUN), calcium (Ca++), total cholesterol (CHOL), creatine kinase (CK), chloride (Cl—), creatinine (CREA), direct bilirubin (D-BIL), gamma glutamyl transferase (GGT), glucose (GLU), high density lipoprotein cholesterol (HDL), potassium (K+), lactate dehydrogenase (LDH), low density lipoprotein cholesterol (LDL), magnesium (Mg), phosphorus (PHOS), sodium (Na+), total carbon dioxide ($TCO_2$), total bilirubin (T-BIL), triglycerides (TRIG), uric acid (UA), total protein (TP), etc.

The tray 80 is reciprocally movably installed in the disc loader 90. A heater 82 is mounted in the tray 80 and serves to keep the sample, etc. received in the disc-shaped member 70 at a constant temperature. A first contact 83 is provided at a lower surface of the tray 80 and is electrically connected to the heater 82.

The disc loader 90 includes a main board (not shown) to control the heater 82 and the drive unit 91. The main board may be connected to a temperature sensor. A second contact 92 is provided at an inner surface of a sidewall of the disc loader 90, so as to be connected to the first contact 83 provided at the tray 80. The second contact 92 is electrically connected to the main board. Similar to the above-described exemplary embodiments, the second contact 92 may, for example, be a leaf spring or a coil spring. Elastic connection between the first contact 83 and the second contact 92 is similar to that of the above-described exemplary embodiments and, thus, a detailed description thereof is omitted.

In the above-described sample analyzing device 200, the heater 82 and the main board are selectively connected to each other via movement and elastic contact of the first and second contacts 83 and 92, rather than being connected via a cable. Accordingly, the sample analyzing device 200 is easy to repair by virtue of easy assembly and separation between the heater 82 and the main board.

The above-described elastic contact configuration is applicable to any rotating appliance, such as a compact disc (CD) player, which has a configuration similar to the sample analyzing device 200 and is driven by rotation of a disc.

Although the present exemplary embodiments illustrate a contact configuration to supply power to a heater, the elastic contact configuration is not limited to the contact configuration for the heater and may be applied to any configuration to supply power to any electric element according to another exemplary embodiment. For example, the elastic contact configuration may be applied to a configuration in which a bulb is turned on or off via relative movement between a first contact and a second contact in another exemplary embodiment.

As is apparent from the above description, a connector and an electric connecting device according to the exemplary embodiments may selectively switch an electric element on or off as occasion demands by allowing the electric element to be moved so as to come into elastic contact with a power source, and may achieve easy assembly and repair.

Although a few exemplary embodiments have been shown and described, it would be appreciated by those skilled in the art that variations may be made in these exemplary embodiments without departing from the principles and spirit of the invention, the scope of which is defined in the claims and their equivalents.

What is claimed is:

1. A connector to connect a heater to a power source, the connector comprising:

a first contact provided on a tray and electrically connected to the heater, wherein the tray has an interior space to store an article; and a second contact provided on a frame that supports the tray and electrically connected to the power source, wherein the tray is movable in and out of the frame, wherein the first contact and the second contact come into contact with or are separated from each other upon receiving pressure caused by relative movement between the tray and the frame, so as to switch the theater on or off, and wherein the heater is mounted in the tray and keeps the article at a constant temperature.

2. The connector according to claim 1, wherein the first contact and the second contact come into contact with or are separated from each other by elasticity of one of the first contact and the second contact.

3. The connector according to claim 2, wherein one of the first contact and the second contact comprises an elastic member, and the other one the first contact and the second contact comprises a rigid member to press the elastic member according to the pressure received by the relative movement between the tray in the frame.

4. The connector according to claim 3, wherein the elastic member is a leaf spring.

5. The connector according to claim 3, wherein the elastic member comprises a coil spring and a pressure plate connected to an end of the coil spring.

6. The connector according to claim 1, wherein the first contact connects to the second contact by fitting.

7. An electric connecting device comprising:

a tray comprising a first contact electrically connected to a heater, wherein the tray has an interior space to store an article; and a frame that supports the tray and comprises a second contact electrically connected to a power source, the tray being movable in and out of the frame, wherein the first contact and the second contact come into contact with or are separated from each other by elasticity as the tray and the frame are moved relative to each other, so as to switch the heater on or off, and wherein the heater is mounted in the tray and keeps the article at a constant temperature.

8. The electric connecting device according to claim 7, wherein:

the first contact and the second contact come into contact with each other by elasticity when the tray is inserted into the frame; and the first contact and the second contact are separated from each other by elasticity when the tray is moved out of the frame.

9. The electric connecting device according to claim 8, wherein the tray is inserted into the frame and is moved out of the frame by a rectilinear movement.

10. The electric connecting device according to claim 7, wherein the first contact or the second contact comprises a leaf spring.

11. The electric connecting device according to claim 7, wherein the first contact or the second contact comprises a coil spring and a pressure plate connected to an end of the coil spring.

12. An electric connecting device comprising:

a tray comprising a first contact electrically connected to an electric element, wherein the tray has an interior space to store an article; and a frame that supports the tray and comprises a second contact electrically connected to a power source, wherein the first contact and the second contact come into contact with or are separated from each other by elasticity as the tray and the frame are moved relative to each other, so as to switch the electric element on or off, wherein the tray is hinged to the frame and pivotally rotatable in and out of the frame, and wherein the electric element is mounted in the tray and keeps the article at a constant temperature.

13. The electric connecting device according to claim 12, wherein:

the tray accommodates, in the interior space thereof, a disc-shaped member receiving a sample therein; and the frame comprises a drive unit to rotate the disc-shaped member.

14. A medical device comprising;

a heater;

a tray comprising a first contact electrically connected to the heater, wherein the tray has an interior space to store an article; and a frame that supports the tray and comprises a second contact electrically connected to a power source, the tray being movable in and out of the frame, wherein the first contact and the second contact come into contact with or are separated from each other by relative movement between the tray and the frame, so as to switch the heater on or off, and wherein the heater is mounted in the tray and keeps the article at a constant temperature.

15. The medical device according to claim 14, wherein the first contact and the second contact come into contact with or are separated from each other by elasticity.

16. The medical device according to claim 15, wherein one of the first contact and the second contact comprises an elastic member, and the other one of the first contact and the second contact comprises a rigid member to press the elastic member.

17. The medical device according to claim 14, wherein the first contact connects to the second contact by fitting.

* * * * *